US005348289A

United States Patent [19]

Vaught

[11] Patent Number: 5,348,289

[45] **Date of Patent: * Sep. 20, 1994**

[54] BREAKAWAY BASKETBALL RIM

[75] Inventor: Russell L. Vaught, Dorchester, Ill.

[73] Assignee: Schutt Manufacturing Company, Litchfield, Ill.

[ * ] Notice: The portion of the term of this patent subsequent to Apr. 21, 2009 has been disclaimed.

[21] Appl. No.: 837,324

[22] Filed: Feb. 18, 1992

Related U.S. Application Data

[63] Continuation-in-part of Ser. No. 472,323, Jan. 30, 1990, Pat. No. 5,106,084.

[51] Int. Cl.[5] ..... A63B 63/08

[52] U.S. Cl. ..... 273/1.5 R; 16/380; 403/362

[58] Field of Search ..... 273/1.5 R, 1.5 A; 172/265, 269; 16/86 R, 86 A, 380, 375, 263; 403/362

[56] References Cited

U.S. PATENT DOCUMENTS

| | | | |
|---|---|---|---|
| 38,233 | 4/1863 | Long . | |
| 48,069 | 6/1865 | Ingels . | |
| 75,669 | 3/1868 | De Turk . | |
| 170,627 | 11/1875 | Harris . | |
| 301,543 | 7/1884 | Wesgate . | |
| 339,632 | 4/1886 | Eubanks . | |
| 418,503 | 12/1889 | Crane . | |
| 790,410 | 6/1905 | Warne . | |
| 1,167,122 | 1/1916 | Simmons . | |
| 1,194,006 | 2/1916 | Fry . | |
| 1,220,648 | 3/1917 | Leader | 403/362 |
| 1,253,961 | 8/1918 | Grimsrud . | |
| 1,278,074 | 9/1918 | Phelps . | |
| 1,879,287 | 9/1932 | Johnson . | |
| 1,884,505 | 10/1932 | Atwood | 16/86 R X |
| 1,915,249 | 6/1933 | Jorgensen | 16/86 R X |
| 2,395,342 | 9/1946 | Morkoski . | |
| 2,506,443 | 10/1950 | Court . | |
| 2,742,843 | 12/1956 | Redetzke . | |
| 2,921,819 | 1/1960 | Rifkin . | |
| 2,935,144 | 8/1960 | Graham . | |
| 2,964,341 | 12/1960 | Doyle et al. . | |
| 3,194,555 | 7/1965 | Humphrey . | |
| 3,402,773 | 9/1968 | Jennings et al. . | |
| 3,462,143 | 8/1969 | Bidelman et al. . | |
| 3,468,382 | 9/1969 | Quanbeck . | |
| 3,534,433 | 10/1970 | Himka et al. | 16/86 A X |
| 3,721,015 | 3/1973 | Sisler et al. . | |
| 3,765,676 | 10/1973 | Bearson et al. . | |
| 3,795,396 | 3/1974 | Kropelnitski . | |
| 3,802,702 | 4/1974 | Pulley . | |
| 3,881,724 | 5/1975 | Beveridge . | |
| 4,026,611 | 5/1977 | Stanwell-Smith . | |
| 4,111,420 | 9/1978 | Tyner . | |
| 4,151,989 | 5/1979 | Dittrich . | |
| 4,194,734 | 3/1980 | Tyner . | |
| 4,353,548 | 10/1982 | Mahoney . | |
| 4,365,802 | 12/1982 | Ehrat . | |

(List continued on next page.)

FOREIGN PATENT DOCUMENTS

| | | | |
|---|---|---|---|
| 604945 | 9/1960 | Canada . | |
| 841107 | 6/1952 | Fed. Rep. of Germany | 403/362 |

(List continued on next page.)

OTHER PUBLICATIONS

"Toss Back grant may bring 20 new jobs to Dorrance," newspaper article (date unknown).

(List continued on next page.)

*Primary Examiner*—Paul E. Shapiro
*Attorney, Agent, or Firm*—Willian Brinks Hofer Gilson & Lione

[57] ABSTRACT

A breakaway basketball goal is disclosed. In one aspect of the invention the goal includes a rim structure which employs a shock absorber. A rim support assembly moves the rim structure from a horizontal position to a nonhorizontal position upon application of a predetermined force to the rim. The shock absorber minimizes the vibrations that the rim support assembly encounters when the rim structure is in the horizontal position and when the rim structure returns to the horizontal position.

15 Claims, 3 Drawing Sheets

U.S. PATENT DOCUMENTS

| | | | |
|---|---|---|---|
| 4,372,703 | 2/1983 | Szostak | 403/362 X |
| 4,438,923 | 3/1984 | Engle et al. | 273/1.5 R |
| 4,441,709 | 4/1984 | Schroeder et al. | 273/1.5 R |
| 4,534,556 | 8/1985 | Estlund et al. . | |
| 4,588,188 | 5/1986 | Mahoney et al. . | |
| 4,676,503 | 6/1987 | Mahoney et al. | 273/1.5 R |
| 4,723,777 | 2/1988 | Jolly . | |
| 5,066,007 | 11/1991 | Niver . | |
| 5,106,084 | 4/1992 | Vaught | 273/1.5 R |

FOREIGN PATENT DOCUMENTS

| | | | |
|---|---|---|---|
| 2515767 | 9/1970 | Fed. Rep. of Germany . | |
| 1479428 | 3/1967 | France . | |
| 286216 | 2/1965 | Netherlands . | |
| 23983 | 2/1896 | United Kingdom | 16/380, |
| 613310 | 11/1948 | United Kingdom . | |
| 908055 | 10/1962 | United Kingdom . | |

OTHER PUBLICATIONS

"Toss Back, Factory Direct Pricing," product brochure (date unknown).

"Western basketball coach invents dunk safe rim," newspaper article (date unknown).

"Toss Back's products score on the courts," newspaper article (date unknown).

"Scouting," The New York Times (Nov. 23, 1985).

"Economic Development Reported," newspaper article (date unknown).

"Inside the NBA," magazine article (date unknown).

"Dunkers Are Strutting Their Stuffs," Sports Illustrated (Mar. 14, 1977).

"The Year of the Superstuffers," Time (Mar. 21, 1977).

"Game Time, Inc." product brochure (1976).

"Miracle Recreation Equipment Company, 1977 Catalog," product brochure (1977).

"The Dunk!", Sun Times (Mar. 6, 1977).

"The Dunk is back!. . . and Illinois State has it!", brochure.

"Wesleyan cagers play tonight," newspaper article (1976).

"Gared Company, Athletic Equipment No. 878," product brochure (date unknown).

Basketball Products, Inc. product brochure (date unknown).

U.S. Patent Application Ser. No. 07/836,120 by Vaught, filed Feb. 14, 1992.

"Slam Dunk Rim, Inc." product brochure (date unknown).

BREAKAWAY BASKETBALL RIM

This application is a continuation-in-part of U.S. application Ser. No. 07/472,323, which was filed on Jan. 30, 1990 now U.S. Pat. No. 5,106,084.

BACKGROUND OF THE INVENTION

This invention relates to basketball goals in general, and in particular to basketball goals of the type which have what is commonly referred to as a breakaway rim. Breakaway rims have become increasingly popular, not only because they are believed by some to reduce damage to backboards, especially when players slam or "dunk" a basketball through the hoop, but because the sight of the rim pivoting downwardly during heated play is apparently particularly appealing to many spectators of the game.

In the past there have been numerous attempts to design and develop basketball goals having breakaway rims. Some of these attempts have been described in U.S. Pat. Nos. 4,111,420; 4,365,802; 4,534,556; and 4,676,503. Though these attempts have achieved varying degrees of success and/or acceptance, they are nonetheless subject to certain drawbacks. These drawbacks relate, for example, to the location and geometry of the component parts, the poor absorption of forces of the component parts during normal play and the rim snapping back into place, the unwanted increase in the tolerances of the component parts, and the susceptibility of such parts to damage and wear.

Accordingly, it is a primary object of this invention to provide an improved basketball goal of the type utilizing a breakaway rim. In particular, it is an object of this invention to provide a basketball goal of the type described wherein any forces that the rim is subjected to are effectively absorbed so that increases in the tolerances of the component parts is minimized which permits a longer lifetime for the rim.

SUMMARY OF THE INVENTION

The foregoing objects of the invention, along with various features and advantages, are achieved in a basketball goal having a support structure adapted to be mounted to a backboard and a rim structure, including a rim, mounted to said support structure. The rim structure moves relative to the support structure by a rim support assembly including a shock absorber. The rim support assembly moves said rim structure from a horizontal position to a nonhorizontal position upon application of a predetermined force to said rim. The shock absorber minimizes the vibrations that the rim support assembly encounters when the rim structure is in the horizontal position and when the rim structure returns to the horizontal position.

In another aspect of the invention the basketball goal further includes a support structure adapted to be mounted to a backboard and a rim structure, including a rim, mounted to the support structure. The basketball goal further includes a rim support assembly including a shaft and a clamp including a mating portion. The clamp has a clamped position engaged with the shaft in the mating portion of the clamp for maintaining the rim in a horizontal position. The clamp further includes an unclamped position wherein the mating portion of the clamp is disengaged from the shaft enabling the rim to swing downwardly in an arcuate path. A coiled spring is operatively mounted to the clamp for maintaining the clamp in the clamped position, and for permitting the clamp to assume the unclamped position and move in the arcuate path upon application of a predetermined force to the rim. There is a rigid member, extending through the spring, having a looped end surrounding the shaft mounted for swinging movement along another arcuate path upon application of the predetermined force, thereby preventing damage to said spring when said clamp assumes said unclamped position. The clamp further includes a pin extending through the clamp enabling the clamp to pivot about the pin when the predetermined force is applied to the rim. An engagement device then is used to engage the pin so that the pin is directed in an opening of the clamp and thus improves the tolerance of the opening.

Further aspects of the invention will become apparent upon reading the following detailed description of the exemplary embodiments of the invention in conjunction with the accompanying drawings.

DETAILED DESCRIPTION OF THE DRAWINGS

Exemplary embodiments of the invention are shown in the following drawings wherein.

DETAILED DESCRIPTION OF EXEMPLARY EMBODIMENTS

Figure 1:
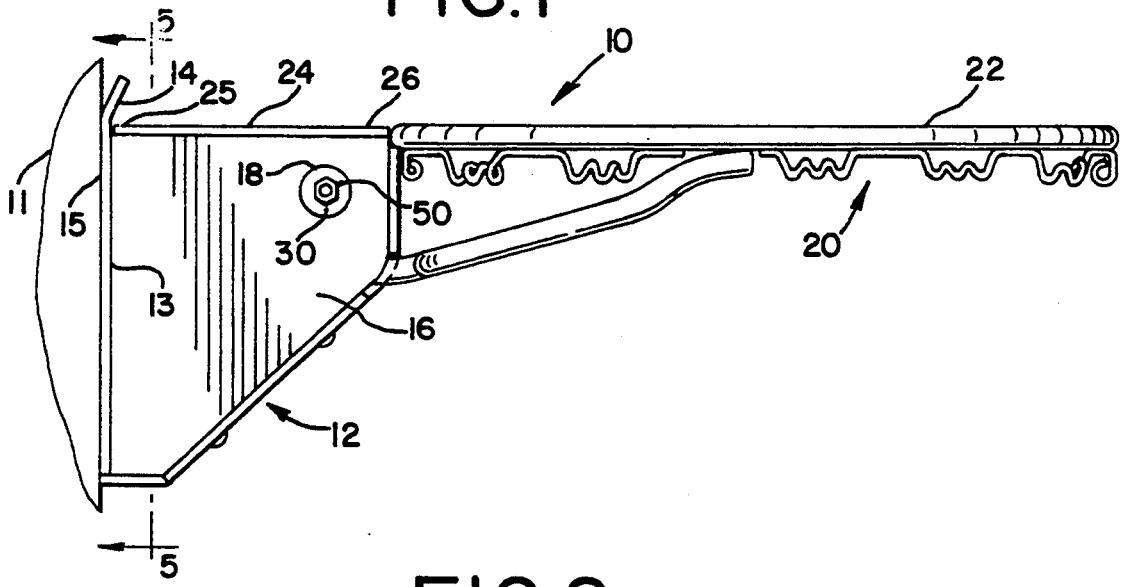
FIG. 1 is side view of an exemplary embodiment of the breakaway basketball rim incorporating the invention.
Figure 2:
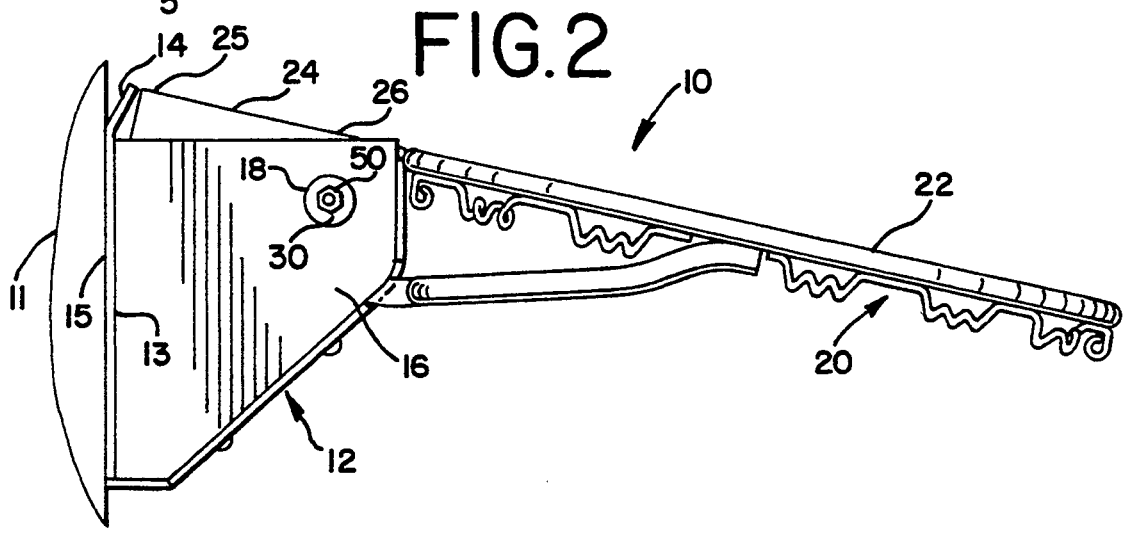
FIG. 2 is a side view of the embodiment shown in FIG. 1 with the rim in a breakaway position inclined from the horizontal.
Figure 3:
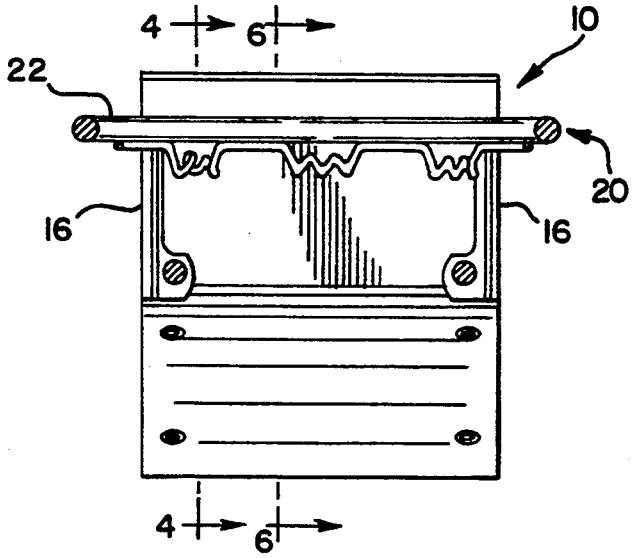
FIG. 3 is a front view of the embodiment shown in FIG. 1.

Referring now to FIGS. 1-3, there is shown a basketball goal 10 of the type that is adapted to be mounted to a backboard 11 for playing the game of basketball. The basketball goal 10 includes a support structure 12 having a stationary rigid base 14 defining an interior surface 13 and an exterior surface 15. Rigid base 14 is adapted to be placed with its exterior surface 15 in flush, facing relation with backboard 11. The support structure 12 further includes a pair of ears 16, each defining a first opening 18, extending outwardly from the stationary rigid base 14.

Figure 5:
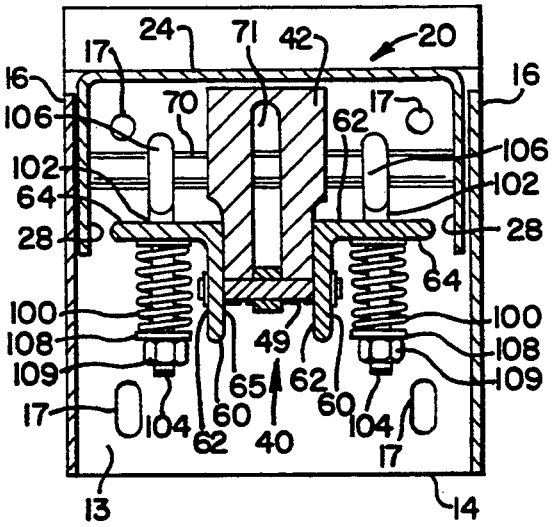
FIG. 5 is a sectional view partially cutaway, of the embodiment of FIG. 1, taken along lines 5—5 thereof.

Stationary rigid base 14 preferably defines several mounting apertures 17 which are shown best in FIG. 5. Apertures 17 are alignable with corresponding openings (not shown) in the backboard 11. To facilitate alignment with the openings in the backboard 11, some of the mounting apertures 17 may be formed in an elongated or oblong shape if desired. Bolts (not shown) are then passed through apertures 17 and the corresponding aligned openings in the backboard 11, and secured by nuts (not shown) to firmly mount the basketball goal 10 to the backboard 11.

The basketball goal 10 further includes a rim structure 20 mounted for releasably pivotal movement relative to the support structure 12 by a rim support assembly 40 shown in FIGS. 4–7. Rim structure 20 has an outwardly extending neck portion 24 and a rim 22. Neck portion 24 defines a proximal end 25 located adjacent the stationary rigid base 14, and a distal end 26 to which rim 22 is secured. The neck portion 24 and the rim 22 are preferably of such size and shape as to conform with the official rules and regulations for the game of basketball.

Figure 8:
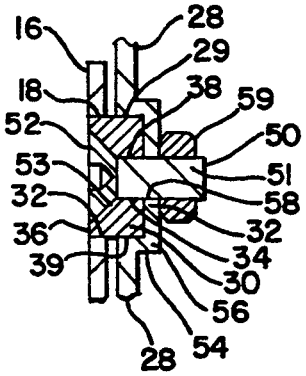
FIG. 8 is a sectional view of a portion of a pivot assembly for the rim shown in the embodiment of FIG. 1.
Figure 9:
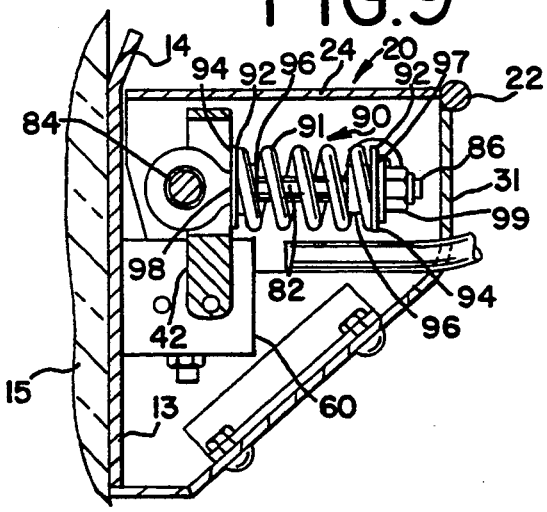
FIG. 9 is a view of another portion of the mounting assembly for the rim shown in the embodiment of FIG. 1.

As shown, for example, in FIG. 8, rim structure 20 further includes a pair of flanges 28 extending downwardly from the neck portion 24, interiorly of and adjacent to corresponding ears 16 of support structure 12. Each of flanges 28 defines a second opening 29, concentric with and adjacent to the corresponding first opening 18 in each of ears 16. The space defined by each one of the first openings 18 and a respective adjacent one of the second openings 29 defines a bearing opening 39, adapted to receive a bearing as explained hereinafter. Thus, in this preferred embodiment, two bearing openings 39 are formed, one in each of the ears 16 extending from support structure 12. Bearing openings 39 define an axis about which the rim structure 20 may pivot relative to the support structure 12.

Still referring to FIG. 8, second openings 29 are preferably formed by corresponding recesses 54 in flanges 28, each of recesses 54 being substantially closed off by an interior wall 56. Each interior wall 56 defines a hole 58 for receiving a bearing-mounting bolt 50. Each bearing mounting bolt 50 comprises a threaded shank 51 and a head 52. Preferably head 52 of bolt 50 is characterized by an interior convex surface 53.

In this preferred embodiment, the basketball goal also includes bearing structure in the form of a pair of substantially disk-shaped bearings 30, each having a center hole 38. Each of bearings 30 has a circumferential bearing surface 32, a substantially flat interior face or surface 34, and an exterior face or surface 36. Exterior surface 36 is preferably concave, and formed to be matingly engagable by the convex surface 53 of bearing-mounting bolt 50. Further, bearings 30 are preferably made of self-lubricating material such as graphite or impregnated plastic.

Each of bearings 30 is mounted within a corresponding one of the two bearing openings 39, with the interior surface 34 in facing relation with a corresponding interior wall 56. Bearings 30 are maintained in that position by inserting the threaded shank 51 of bolt 50 through both the center hole 38 of bearing 30 and the hole 58 in the interior wall 56 of recess 54. A nut 59 is then tightened onto the end of the threaded shank 51 protruding through the hole 58. When so tightened, the convex surfaces 53 of bolts 50 are against the concave exterior surfaces 36 of bearings 30, resulting in a firm fit of bearings 30 in their respective bearing openings 39. Thus, the bearing surface 32 of each bearing 30 is accurately positioned relative to the edges of the ears 16 and the flanges 28 defined by the first opening 18 and the second opening 29, respectively.

When bearings 30 are so mounted, they define pivot points for the rim structure 20 to move relative to the support structure 12. Since the bearings 30 are firmly maintained in their respective bearing openings 39 in the manner described, such pivotal movement will occur in a smooth, consistent manner. Moreover, since the bearings 30 are self-lubricating, these movements can be reliably repeated almost indefinitely, without need for adjustment or maintenance. However, should the tolerance increase the bearings 30 allow for easy adjustment or replacement to ensure improved maintenance which allows for an indefinite time frame of repeatability. Further, these beneficial results are achieved without cluttering the interior mechanism of the goal 10 with additional mechanical structures, which could interfere with the operation of the goal and/or its mounting to the backboard.

As previously mentioned, the pivotal movement of rim structure 20 relative to support structure 12 is accomplished, at least in part, by the rim support assembly 40. As shown in FIGS. 1, 2, 4, 6, 7, and 9, the rim support assembly 40 is enclosed by a removable cover plate 31. Cover plate 31 is curved such that it is parallel to the slanted edges of the ears 16 and parallel to vertical edges of the ears 16 nearest the rim. The cover plate 31 is attached to the ears 16 by attachment means, such as nuts and bolts. The cover plate 31 extends from the top of the ears 16 to just before the backboard 15, thus ensuring that a person cannot insert a hand in the rim support assembly 40 and get injured.

As shown in FIGS. 4–7, rim support assembly 40 includes a pair of L-shaped brackets 60 each having a first leg 62 and a second leg 64. Each bracket 60 is fixedly secured to the interior surface 13 of rigid base 14 with their first legs 62 being substantially parallel and separated by a gap 65 shown in FIG. 5. The second legs 64 of brackets 60 extend in opposite directions toward respective flanges 28.

Figure 4:
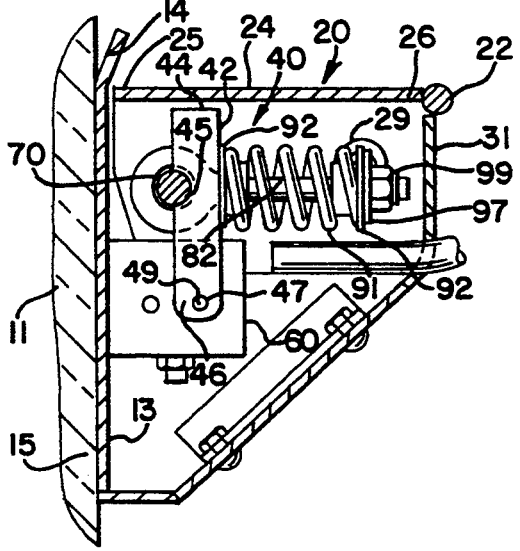
FIG. 4 is a sectional view of the embodiment of FIG. 1, taken along lines 4—4 of FIG. 3.

Rim support assembly 40 further includes a unitary clamp 42 disposed in the gap 65, having a free upper end 44 and a pivoted lower end 46 shown best in FIG. 4. A shaft opening 47 is defined in the lower end 46 of clamp 42, and is adapted to receive a pin 49 having its ends secured, respectively, to the first legs 62 of brackets 60. When clamp 42 is mounted in the manner described, it is able to pivot about pin 49 with its upper end 44 defining an arcuate path when such pivoting occurs.

Figure 11:
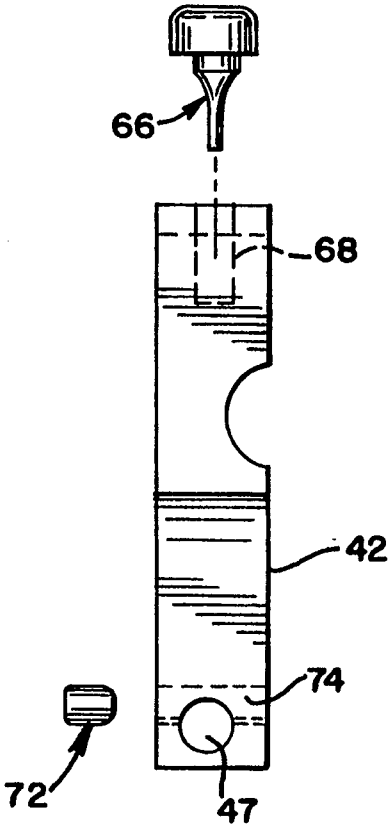
FIG. 11 is a side view of the embodiment of the clamp of FIG. 10.
Figure 10:
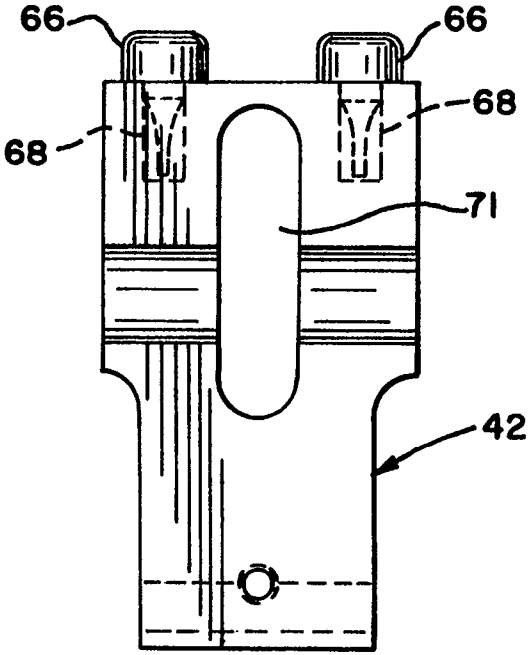
FIG. 10 is a rear view of an embodiment of the clamp employing bumpers.

In order for the clamp 42 and the neck portion 24 to freely pivot all component parts of the breakaway rim are made with tolerances to improve the ease of construction. Though tolerancing improves the pivoting of the device tolerancing will also lead to unwanted vibrations in the component parts of the breakaway rim when the clamp 42 is in the clamped position, which may occur when a basketball rebounds off of the rim 22 for example. If the component parts are subject to those vibrations for a significant amount of time it would eventually increase the tolerances of some of the component parts and lead to a shorter lifetime of the component parts and the breakaway rim. In order to reduce the above mentioned increase in the tolerances to the component parts, one or more bumpers 66 are employed as shock absorbers, as shown in FIGS. 10 and 11. The bumpers 66 are attached to the upper end 44 of the clamp 42 and are dimensioned such that they make intimate contact with the neck portion 24 when the clamp 42 is in the clamped position. When the bumpers 66 are in intimate contact with the neck portion 24 all of the component parts of the breakaway rim are in intimate connection with each other such that when vibrations are produced on the rim 22 the amount of vibration experienced by the component parts is minimized. The minimization of vibration consequently reduces any tendency to increase the tolerance of the component parts and thus the lifetime of the breakaway rim is lengthened.

A further advantage of the bumpers 66 is that they help to cushion the forces that result when the rim 22 snaps back into its normal horizontal position. The snapping back action produces unwanted vibrations if unchecked. As with the vibrations produced by basketballs rebounding off the rim 22, the vibrations from the snapping back motion would tend to increase the tolerances of the elements and lead to a decreased lifetime for the device. The bumpers 66 absorb the force from the snapping back motion and minimizes the vibration of the elements. Thus, any increase in tolerance in the elements is minimized.

In the embodiment of FIGS. 10 and 11, two cylindrical holes 68 having a diameter of approximately $\frac{1}{4}''$ and a depth of approximately $\frac{5}{8}''$ are formed in the upper end 44 of the clamp 42. Each hole 68 is centrally located on either side of opening 71 of the clamp. A bumper 66 is pressed inside each hole 68. Each bumper is made of a compressible rubber-like material, such as urethane, which compresses upon a force being applied thereto and which returns to its original shape upon a force being discontinued. An exemplary bumper made of butyl rubber (hardness of $40\pm5$ measured on a durometer) is available from Syracuse Rubber as Model No. M-22-A-2.

Once inserted the bumpers 66 extend above the upper end 44 of the clamp 42 so as to engage the neck portion 24 when the rim is in a rest or nonbending position. Furthermore, the embodiment of FIGS. 10 and 11 employs an engagement device such as a set screw 72 which is inserted in a cylindrical-like aperture 74 positioned perpendicular and off-set to the shaft opening 47. Aperture 74 partially intersects shaft opening 47 so that when pin 49 is present in shaft opening 47 the set screw 72 will engage the pin 49. When screw 72 engages pin 49, the pin is directed downward in shaft opening 47 and thus improves the tolerance of shaft opening 47. Set screw preferably is a $\frac{1}{4}$-20 set screw.

Clamp 42 is adapted to cooperate with a male locking element such as catch 70, the ends thereof being fixedly secured to respective flanges 28, and being spaced above the interior surface 13 of rigid base 14, all as shown in FIG. 4. Catch 70 may have any desired cross-sectional shape, such shape being circular to provide a cylindrical element in this particular embodiment. Disposed near the upper end 44 of clamp 42 is a mating portion such as a female mating portion with a cut-out 45 which is preferably contoured to substantially correspond to the cross-sectional shape of catch 70. Thus, in this embodiment, cut-out 45 is substantially of a semicircular contour as shown, for example, in FIG. 4.

Rim support assembly 40 also includes a spring attachment means such as a rigid member to attach the spring to the rim structure and which, in this exemplary embodiment, is an eyebolt 82. As shown best in FIG. 9, eyebolt 82 has one end defining a loop 84 and a threaded end 86. Catch 70 extends through the loop 84 of eyebolt 82, thereby enabling the threaded end 86 of eyebolt 82 to pivotably move in an arcuate path about catch 70 when a breakaway force is applied to rim 22.

In this exemplary embodiment rim support assembly 40 further includes a spring assembly 90. As shown best in FIG. 9, spring assembly 90 desirably includes a coiled spring 91 defining an inner diameter, and a pair of mounting washers 92. Each of mounting washers 92 has an eyebolt-receiving hole 98, a flat exterior surface 94 and a raised cylindrical portion 96 somewhat smaller in diameter than the inner diameter defined by the coiled spring 91.

In assembly, the eyebolt-receiving hole 98 of one of the mounting washers 92 is placed over the eyebolt 82, and the mounting washer is pushed inwardly until the flat exterior surface 94 rests against the clamp 42. The coiled spring 91 is then placed about eyebolt 82 and pushed inwardly until the raised cylindrical portion 96 of mounting washer 92 is disposed inside at least a portion of the lower-most coil of spring 91, and the exterior surface 94 rests against clamp 42. The other mounting washer is then placed over eyebolt 82 with its raised cylindrical portion 96 disposed within at least a portion of the upper-most coil of spring 91. A metal washer 97 is then placed over the threaded end of eyebolt 82, resting against the exterior surface 94 of the last-mentioned mounting washer 92. A nut 99 is then screwed onto the threaded end of eyebolt 82 with a tightness which predetermines the amount of force that must be applied to rim 22 in order to achieve a desired breakaway condition. In other words, when nut 99 is tightened onto the threaded end 86 of eyebolt 82, coiled spring 91 is compressed to a predetermined tension, thereby establishing a predetermined breakaway force.

When the spring assembly 90 is properly assembled, the catch 70 will be captured by the cut-out 45 in the clamp 42. When so captured, the rim support assembly 40 supports and substantially immobilizes the entire rim structure 20, including flanges 28, neck portion 24 and rim 22, in a first, clamped position wherein the rim 22 extends outwardly in a substantially horizontal position. When the predetermined breakaway force, typically about 230 pounds, is applied to the rim 22, spring 91 flexes, and eyebolt 82 and coiled spring 91 pivotably move in the arcuate path previously described. This movement, in turn, releases the catch 70 from the clamp 42. When so released, the rim structure 20 will pivotably move in an arcuate path about the pivot points defined by bearings 30. As such, rim 22 will move from a substantially horizontal position to an unclamped position, inclined from the horizontal. Furthermore, the catch 70 will move so as to engage a resting portion on the clamp 42 when the clamp 42 is in the unclamped position. Because both the eyebolt 82 and the rim structure 20 move in an arcuate path, when the catch 70 is released from the clamp 42, the chance of causing damage to the eyebolt 82, the spring 91, or any of the other components of goal 10, is minimized.

Figure 6:
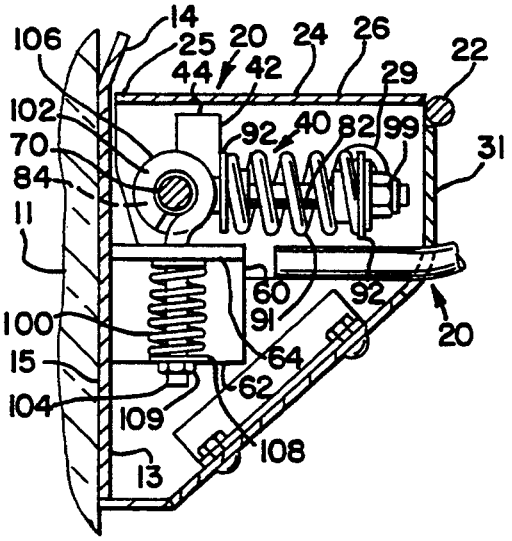
FIG. 6 is a sectional view, partially cutaway, of the embodiment of FIG. 1, taken along lines 6—6 of FIG. 3.
Figure 7:
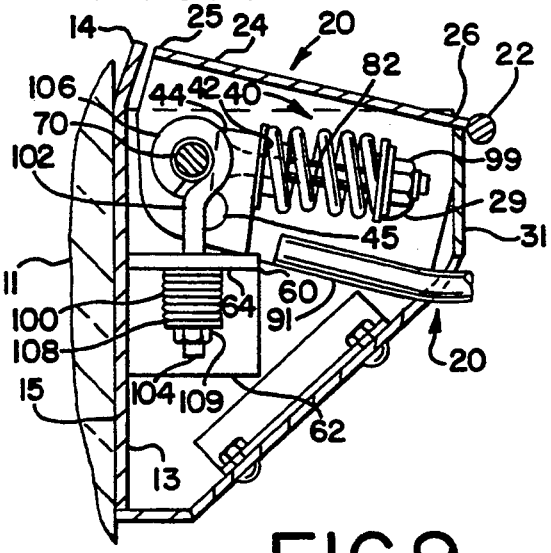
FIG. 7 is a sectional view, partially cutaway, of the embodiment of FIG. 1 with the rim in the breakaway position shown in FIG. 2.

As shown in FIGS. 5–7, the basketball goal 10 further includes a pair of return springs 100 used to return the rim 22 to its original, horizontal position when the breakaway force applied thereto is released. Both of springs 100 are mounted in place by an eyebolt 102, each eyebolt 102 having a threaded end 104 and a looped end 106. In assembly, the catch 70 extends through the looped end 106 of each one of eyebolts 102 which are located on opposite sides of loop 84 of eyebolt 82. Each of the eyebolts 102 also extends through an appropriately located and dimensioned hole defined in the second leg 64 of each L-shaped bracket 60, and through the length of a corresponding one of springs 100. A washer 108 is placed over the threaded end 104 of each eyebolt 102, and a nut 109 is tightened thereon.

The return force to be applied by springs 100 is determined by the tightness of the nuts 109. Preferably, this force is substantially less than the predetermined breakaway force previously described, but sufficient to urge the rim structure 20 to pivotably move in the opposite direction about bearings 30 until clamp 42 again captures catch 70. When this occurs, rim 22 will, of course, be returned to its horizontal clamped position. As described previously, when the rim 22 returns to its horizontal position bumpers 66 makes contact with the neck portion 24 and absorbs the force from the snapping back motion of the rim 22. Thus, the amount of shock transferred to the component parts is minimized and helps to prevent the increase in the tolerances of those component parts.

What has been described is a novel basketball goal of the type utilizing a breakaway rim. As explained, this goal, and its various components, minimize the increase in the tolerances of the component parts and lead to a longer lifetime for the breakaway rim. Though the exemplary embodiments described herein are preferred, it is contemplated that other embodiments which do not part from the true scope of the invention, will become apparent to those skilled in the art. Accordingly, all such embodiments, are intended to be covered by the appended claims.

I claim:

1. A basketball goal comprising:

support structure adapted to be mounted to a backboard;

a rim structure, including a rim, mounted to said support structure; and a rim support structure including a shaft, a clamp including a mating portion and a shock absorber, said clamp having a clamped position engaged with said shaft in said mating portion of said clamp for maintaining said rim in a horizontal position, and an unclamped position wherein said mating portion of said clamp is disengaged from said shaft enabling said rim to swing downwardly in an arcuate path; a coiled spring, operatively mounted to said clamp, for maintaining said clamp in said clamped position, and for permitting said clamp to assume said unclamped position and move in said arcuate path upon application of a predetermined force to said rim; and a rigid member, extending through said spring, having a looped end surrounding said shaft mounted for swinging movement along another arcuate path upon application of said predetermined force, thereby preventing damage to said spring when said clamp assumes said unclamped position.

2. The basketball goal defined in claim 1 wherein said rigid member includes a threaded end, further including a nut tightened onto the threaded end of said bolt for compressing said coiled spring to a predetermined tension, thereby establishing said predetermined force.

3. The basketball goal defined in claim 1 further includes a pin extending through said clamp, thereby enabling said clamp to pivot about said pin when said predetermined force is applied to the pin.

4. The basketball goal defined in claim 1 wherein said shock absorber comprises one or more bumpers.

5. The basketball goal defined in claim 4, wherein said one or more bumpers engage said rim structure when said clamp is in said clamped position.

6. The basketball goal defined in claim 5, wherein said one or more bumpers are separate from said rim structure when said clamp is in said unclamped position.

7. The basketball goal defined in claim 4, wherein said one or more bumpers are comprised of a compressible material which compresses upon a force being applied thereto.

8. The basketball goal defined in claim 4, wherein said one or more bumpers are comprised of a compressible material which returns to its original shape upon said force being discontinued.

9. The basketball goal defined in claim 8, wherein said compressible material comprises a rubber-like material.

10. The basketball goal defined in claim 1, wherein said shock absorber engages said rim structure when said clamp is in said clamped position.

11. The basketball goal defined in claim 10, wherein said shock absorber is separate from said rim structure when said clamp is in said unclamped position.

12. A basketball goal comprising:

support structure adapted to be mounted to a backboard;

a rim structure, including a rim, mounted to said support structure; and a rim support assembly including a shaft, a clamp including a mating portion, said clamp having a clamped position engaged with said shaft in said mating portion of said clamp for maintaining said rim in a horizontal position, and an unclamped position wherein said mating portion of said clamp is disengaged from said shaft enabling said rim to swing downwardly in an arcuate path; a coiled spring, operatively mounted to said clamp, for maintaining said clamp in said clamped position, and for permitting said clamp to assume said unclamped position and move in said arcuate path upon application of a predetermined force to said rim; and a rigid member, extending through said spring, having a looped end surrounding said shaft mounted for swinging movement along another arcuate path upon application of said predetermined force, thereby preventing damage to said spring when said clamp assumes said unclamped position; and wherein said clamp further includes (1) a pin extending through said clamp enabling said clamp to pivot about said pin when said predetermined force is applied to the pin and (2) an engagement device to engage said pin.

13. The basketball goal defined in claim 12 wherein said rigid member includes a threaded end, further including a nut tightened onto the threaded end of said bolt for compressing said coiled spring to a predetermined tension, thereby establishing said predetermined force.

14. The basketball goal defined in claim 12, wherein said engagement device is positioned off-set and perpendicular to said pin.

15. The basketball goal defined in claim 14, wherein said engagement device is a screw.

* * * * *